US010316838B2

(12) United States Patent
Downing

(10) Patent No.: US 10,316,838 B2
(45) Date of Patent: Jun. 11, 2019

(54) METHOD AND APPARATUS FOR PREVENTING GAS LOCK/GAS INTERFERENCE IN A RECIPROCATING DOWNHOLE PUMP

(71) Applicant: Downing Innovations, LLC, San Antonio, TX (US)

(72) Inventor: Donald R. Downing, San Antonio, TX (US)

(73) Assignee: DOWNING INNOVATIONS, LLC, San Antonio, TX (US)

( * ) Notice: Subject to any disclaimer, the term of this patent is extended or adjusted under 35 U.S.C. 154(b) by 112 days.

(21) Appl. No.: 15/250,102

(22) Filed: Aug. 29, 2016

(65) Prior Publication Data

US 2017/0058635 A1 Mar. 2, 2017

Related U.S. Application Data

(60) Provisional application No. 62/210,663, filed on Aug. 27, 2015.

(51) Int. Cl.

| | |
|---|---|
| ***E21B 43/12*** | (2006.01) |
| ***F04B 53/06*** | (2006.01) |
| ***F04B 47/02*** | (2006.01) |
| ***F04B 53/10*** | (2006.01) |

(52) U.S. Cl.

CPC ..... *F04B 53/06* (2013.01); *E21B 43/127* (2013.01); *F04B 47/02* (2013.01); *F04B 53/10* (2013.01)

(58) Field of Classification Search

CPC ..... F04B 53/10; E21B 43/127
USPC ..... 166/373
See application file for complete search history.

(56) References Cited

U.S. PATENT DOCUMENTS

| | | | | |
|---|---|---|---|---|
| 3,162,143 | A * | 12/1964 | Ferguson | F04B 47/00 417/459 |
| 3,267,872 | A * | 8/1966 | Bloudoff | F04B 47/00 417/259 |
| 6,830,441 | B1 | 12/2004 | Williams | |
| 6,899,127 | B1 | 5/2005 | Swingley | |

* cited by examiner

*Primary Examiner* — Taras P Bemko
(74) *Attorney, Agent, or Firm* — Schmeiser, Olsen & Watts, LLP

(57) ABSTRACT

An apparatus for reducing or eliminating gas lock in a downhole pump is provided. The apparatus has a ported bushing connecting to an upper standing valve at a first, uphole end and connecting to a lower standing valve at a second, downhole end. The apparatus also has one or more vents. In one embodiment, the apparatus is coupled downhole of a traveling valve of a downhole pump such that, on each upstroke, the one or more vents of the apparatus draw liquid from the annulus between the pump and the tubing into the passage between the upper and lower standing valves for opening the upper standing valve to accumulate liquid in the pump barrel below the traveling valve. The accumulation of liquid in the pump barrel below the traveling valve breaks gas lock and opens the traveling valve, ensuring the operation of pumping liquid from downhole to surface.

19 Claims, 13 Drawing Sheets

METHOD AND APPARATUS FOR PREVENTING GAS LOCK/GAS INTERFERENCE IN A RECIPROCATING DOWNHOLE PUMP

CROSS-REFERENCE TO RELATED APPLICATION

This Application claims priority to U.S. Provisional Patent Application No. 62/210,663, filed Aug. 27, 2015.

FIELD OF TECHNOLOGY

The following relates to downhole reciprocating pumps used to pump oil and other fluids from oil wells and, in particular, to a method and apparatus for minimizing or overcoming gas locking and or gas interference.

BACKGROUND

When an oil well is first drilled and completed, the fluids, such as crude oil, in the wellbore may be under natural pressure sufficient to produce on its own. In other words, the oil rises to the surface without any assistance. In many oil wells however and particularly those having been established for years, natural pressure can decline to a point where the oil must be artificially lifted to the surface. For artificially lifting oil, subsurface pumps are located downhole in the well below the level of the oil. A string of sucker rods extends uphole from the pump to the surface to a pump jack device, or beam pump unit. A prime mover, such as a gasoline or diesel engine, or an electric motor, on the surface causes a pivoted walking beam of a pump jack to rock back and forth, one end connected to a string of sucker rods for moving or reciprocating the string up and down inside of the well tubing.

As is known, a string of sucker rods operates the subsurface pump, with the typical pump having a plunger that is reciprocated inside of a pump barrel by the sucker rods. The barrel has a standing one-way valve adjacent a downhole end, while the plunger also has a one-way valve, called a travelling valve. Alternatively, in some pumps the plunger has a standing one-way valve, while the barrel has a traveling one-way valve. Relative movement alternatively charges the pump chamber, between the standing and travelling valves, with a bolus or increment of liquid and then transfers the bolus of liquid uphole. More specifically, reciprocation charges a displacement pump chamber between the valves with fluid and then displaces the fluid out of the chamber to lift the fluid up the tubing towards the surface. The one-way valves open and close according to pressure differentials across the valves.

Pumps are generally classified as tubing pumps or insert pumps. A tubing pump includes a pump barrel which is attached to the end joint of the well tubing. The plunger is attached to the end of the rod string and inserted down the well tubing and into the barrel. Tubing pumps are generally used in wells with high fluid volumes. An insert pump has a smaller diameter and is attached to the end of the rod string and run inside of the well tubing to the bottom. The non-reciprocating component is held in place by a hold-down device that seats into a seating nipple installed on the tubing. The hold-down device also provides a fluid seal between the non-reciprocating barrel and the tubing.

The hold down device may be assembled to provide for either, or both of, a top hold down configuration or top anchoring of the downhole pump, or a bottom hold down configuration or bottom anchoring of the downhole pump.

A top anchored rod pump is generally used in shallower, e.g., 5000 feet or less, sandy, low fluid level, gassy, or foamy wells, and has some benefits to those well known to the pump industry, while the bottom anchored rod pump has benefits in deeper wells.

The benefit and disadvantages of both top and bottom anchored pumps would be well known to those familiar with rod pump selection procedures and will not be discussed in further detail here.

Volumetric efficiency of a pump is reduced in wells that have gas. The displacement chamber between the standing and traveling one-way valves fails to fill completely with liquid. Instead, the displacement chamber also contains undissolved gas, air or vacuum, which are collectively referred to herein as "gas".

The gas may be undissolved from the liquid (so called "free gas"), or it may be dissolved in the liquid (so called "solution gas") until subjected to a drop in pressure in an expanding displacement chamber, wherein the gas comes out of solution. Gas takes the place of liquid in the displacement chamber, permitting a compression of the gassy fluid in the chamber and diminishing the displacement and lifting of liquid therefrom. The presence of gas in the displacement chamber reduces the efficiency of the pump, and lifting costs to produce the liquid to the surface are increased. This condition is known as "gas interference".

The presence of too much gas in the displacement chamber can completely eliminate the ability of the pump to lift liquid. This is because the gas in the displacement chamber prevents the contents therein from being compressed to a high pressure sufficient to overcome the hydrostatic pressure above on the traveling valve. This condition is known as "gas locked", and is a type of gas interference. In other words, the pump can become gas-locked when a quantity of gas becomes trapped between the traveling valve and the standing valve balls. Hydrostatic pressure above the traveling valve ball holds the ball in a seated position, while the pressure from the trapped gas will hold the standing valve ball in a seated position. With the balls unable to unseat, pumping comes to a halt with reduction or cessation of liquid production and other related issues.

In common field practice, a common method to break a gas lock in a conventional pump is to adjust the spacing of the pump setting, placing the bottom of the stroke into an interference state during reciprocation, and tap or impact the pump hard on the down stroke. This is done in an effort to jar the travelling valve open so as to break a gas lock. Hitting the pump to open the valves causes damage to pump components and the rod string. The adjustment of the pump requires a service visit and the extent of the tap is not always appreciated at the surface when the impact actually occurs one or more kilometers downhole. Further, rather than have service personnel return multiple times in response to repeated gas locking, a pump might actually be left configured to tap bottom continuously, damaging the sucker rods, rod guides, pump plunger and barrel.

Other attempts to solve the gas lock problem have concentrated on the valves, and the compression of a gas in the displacement chamber. One typical attempt is to remove the oil pump or the plunger from the barrel, and release the trapped gas. This can be time-consuming and interrupts pumping operations.

Operating the pump in a gas locked condition is undesirable because energy is wasted in that the pump is reciprocated but no fluid is lifted. The pump, sucker rod string, surface pumping unit, gear boxes and beam bearings can experience mechanical damage due to the downhole pump plunger hitting the liquid-gas interface in the displacement chamber on the down stroke. Loss of liquid lift leads to rapid wear on pump components, as well as stuffing box seals. This is because these components are designed to be lubricated and cooled by the well liquid.

Gas locking, and implementation of the above-mentioned solution for overcoming same, not only damages the pump and stuffing box, but can reduce the overall productivity of the well. Producing gas without the liquid component removes the gas from the well. The gas is needed to drive the liquid from the formation into the well bore.

Still another problem arises in the Texas Panhandle of the United States, where some oil fields have a minimum gas-to-oil ratio production requirement. In other words, both gas and oil must be produced. Many gas wells are unable to produce gas at their full potential because the downhole pumps are unable to lift the liquid, as the pumps are essentially gas locked.

Still another problem arises in stripper wells, which are wells that produce ten barrels or less of liquid each day. Stripper wells are low volume wells. The output from a stripper well is produced into a stock tank on the surface. Separation equipment, which separates the gas from the well, is not used because the production volume is too low to justify the expense of separation equipment. Produced gas is vented off of the stock tank into the atmosphere, contributing to air pollution and a waste of natural gas.

Still another problem arises in wells with little or no "rat hole". The rat hole is the distance between the deepest oil, gas and/or water producing zones and the plugged back, or deepest depth of the well bore. Conventional downhole pumps cannot pump these wells to their full potential due to the low working submergence of the pump in the fluid. The low submergence results in both liquid and gas being sucked into the displacement chamber. If insufficient volumes of liquid are drawn into the chamber, the pump becomes gas locked. In low volume wells, the common practice is to shut the pump off for a period of time to allow sufficient liquid to enter the well bore. But, in wells with little or no rat hole, shutting the pump off has no effect because the liquid level is too low. Deepening the well bore is typically too expensive. While these wells do contain oil, it cannot be produced with known pumps.

There are also many wells which produce fluids having a high gas content. The pumping efficiency of conventional pumps, as hereinabove discussed, is considerably reduced, and pumping action can be completely blocked. While a liquid is substantially incompressible, hydraulically opening the check valves during the reciprocating pump stroke, a gas is compressible. Thus, gas located between the traveling check valve and the standing check valve can merely compress during the down stroke without generating sufficient pressure to open the traveling valve. No liquid is then admitted above the valve to be lifted during the up stroke and the pump is gas locked. This problem is aggravated in large bore pumps, where considerably more internal volume in the displacement chamber is available for gas accumulation, with concomitant low pressurization during compression.

In the past, it has been suggested to remedy such gas locking condition by preventing gas from reaching the pump. One way this was accomplished was by using an annulus below the pump inlet. However, in order to implement such a remedy, accurate data is required about the generally unknown formation characteristics. Furthermore, the fluid reservoir characteristics of such formations change with time, requiring constant adjustments to the pump installations. As such, the annulus method of preventing gas from reaching the pump is neither practical nor effective.

Such failures to completely fill the chamber are attributed to various causes. In a gas lock situation or a gas interference situation, the formation produces gas in addition to liquid. The gas collects at the top of the chamber, while the liquid is at the bottom, creating a liquid-to-gas interface. If this interface is relatively high in the chamber, then gas interference results. In gas interference, the plunger, on down strokes, descends in the chamber and hits the liquid-to-gas interface. The change in resistances causes a mechanical shock or jarring. Such a shock damages the pump, the sucker rods and the tubing. If the liquid-to-gas interface is relatively low in the chamber, gas lock results, wherein insufficient pressure is built up inside of the chamber on the down stroke to open the plunger valve. The plunger is thus not charged with liquid and the pump is unable to lift anything. A gas locked pump, and its associated sucker rods and tubing, may experience damage from the plunger hitting the interface.

In a pump off situation, the annulus surrounding the tubing down at the pump has a low fluid level, and consequently a low fluid head is exerted on the barrel intake valve. In an ideal pumping situation, when the plunger is on the upstroke, the annulus head pressure forces annulus fluid into the chamber. However, with a pump off condition, the low head pressure is unable to force enough fluid to open the valve and completely fill the chamber. Consequently, the chamber has gas, air or a vacuum therein. A pump in a pump off condition, as well as its associated equipment, suffers mechanical shock and jarring as the plunger passes through the liquid-to gas interface. A restricted intake can also cause pump off.

There is therefore a need for apparatus and methodologies that can effectively address gas lock/gas-interference in downhole reciprocating pumps.

Further to the foregoing, pump valves are designed for hostile environments, as they are subject to high pressures, high temperatures and corrosive fluids. The valves include a valve seat and a ball. The valve seat is a ring having a lapped, or shaped, surface for receiving the ball. When the ball engages the seat, the valve is closed. When the ball is disengaged from the seat, the valve is opened. Differential pressure moves the ball into or out of engagement with the seat.

For example, traveling valve assemblies are designed to allow the fluid that has entered the pump on the previous upstroke to pass through it with minimal pressure differential created during the down-stroke cycle of the pump. This is because, as the pressure differential increases, weight from the sucker rods directly above the pump is required to force the liquid through the plunger, and too much weight will cause them to buckle slightly and to come into contact with the inside of the tubing string, causing wear on the tubing string and on the sucker rods. It is therefore desirable to lower the force required to move the plunger through the fluid, not only to increase pumping rate and overall system efficiency, but to reduce wear.

An improperly guided ball in either valve will have difficulty seating, resulting in improper closure and leaking through the valve. Ball cages are used to constrain the movement of the ball and ensure a properly working valve, and are well-known in the art. The cage limits the movement of the ball axially along a narrow path and/or prevents the ball from oscillating and causing excessive wear. The tolerance between the ball and the inside side walls of the cage is small in order to minimize side-to-side movement of the ball. In addition, the cage provides openings around the ball for fluid to flow. See for example U.S. Pat. No. 6,830,441 to Williams.

Some wells produce relatively large quantities of sand. As the sand flows through the valve, it tends to accumulate and cause a loss in efficiency in pumping fluid to the surface, for example by choking off fluid flow, or by interfering with the ability of the ball to reseat and seal the valve, to release from the valve seat or to find the valve seat.

The ball and seat components used in both the traveling valve and the standing valve are exposed to excessive wear as a result of a number of factors, including the turbulent flow of fluids at high pressures. The turbulence leads to uncontrolled movement of the ball in the valve cage, or rattling side-to-side, eventually causing damage to both the ball and valve cage. Several attempts have been made to minimize rattling within ball check valves. See for example U.S. Pat. No. 6,899,127 to Swingley which describes methods that are relatively effective in minimizing rattle, but that also increase friction and therefore result in a decrease in the kinetic energy of the liquid flowing through the valve and an increase the pressure drop across the valve with all the disadvantages associated therewith.

Eventually, pump components need to be replaced as a result of being exposed to excessive wear and damage. In the past, valve cages have been equipped with hardened liners, in order to increase valve cage life. However, hardened liners can be expensive.

Valve cages commonly comprise guides, which may be formed either of hard metal or of elastomer pieces fixed within the cage. While elastomers are useful for wear aspects, they are not usually structural per se. Elastomer guides are difficult to assemble in the structural aspect of the cage and in lock in place. Unless pins or clips are used as locking means, it has been necessary to distort the guide pieces to insert or remove them.

There remains a need in the art for a pump valve that minimizes sand accumulation in the valve, that maximizes the flow capacity of the fluid of the cage, minimizing pressure drop across the valve, that minimizes the effects of travelling ball movement without causing additional friction, that maximizes the suspension time of solids within the fluids, which enhances flow capability of the fluid through the cage and through the tubing string, that further reduces or eliminates wear, avoids using guides, and that maximizes efficiency or operational capacity of the pump.

SUMMARY

An aspect relates to an apparatus and methodologies for reducing gas interference in a downhole pump. More specifically, the present apparatus and methodologies may reduce or eliminate gas lock in a reciprocating pump positioned within a subterranean wellbore.

In one embodiment, the present apparatus for reducing gas interference is provided in a pump, the pump comprising at least one standing valve, at least one traveling valve, a cylindrical barrel positioned therebetween, and at least one reciprocating piston operative to open and close the valves. The present apparatus may comprise at least one cylindrical bushing forming a fluid bore, the bushing having an uphole and a downhole end, the downhole end being in fluid communication with at least one downhole standing valve for receiving fluids drawn from the wellbore into the bore, and the uphole end being in fluid communication with at least one uphole standing valve for transporting fluids within the bore to the cylindrical barrel, the bushing having at least one fluid port, extending through the wall of the bushing, for directing fluids from the annulus of the wellbore into the fluid bore wherein fluids from the annulus increase the hydrostatic pressure of the fluids within the bore to reduce gas interference therein, enabling opening and closing of the traveling valve upon reciprocation of the piston.

In another embodiment, the present methodologies for reducing gas interference in a reciprocating pump comprises sealingly positioning the pump within the annulus of a subterranean wellbore, the pump comprising at least one traveling valve, at least two standing valves and a cylindrical bushing positioned therebetween and in fluid communication therewith, a cylindrical barrel and at least one reciprocating piston operative to open and close the valves, injecting fluids into the annulus of the wellbore, operating the pump by reciprocally moving the piston upwardly, opening the at least one standing valve downhole of the bushing, drawing fluids from the reservoir into the bushing, opening the at least one standing valve uphole of the bushing, drawing fluids from the bushing into the cylindrical barrel, and receiving injected fluids from the annulus into the bushing, increasing the hydrostatic pressure therein, and moving the piston downwardly, opening the at least one traveling valve, increasing pressures within the bushing, and pumping the reservoir fluids uphole through the barrel.

In another embodiment, the present apparatus comprises a modified valve for use in a reciprocating pump for recovering reservoir fluids from a subterranean wellbore, the pump having at least one standing valve, at least one traveling valve, a cylindrical barrel positioned therebetween, and at least one reciprocating piston operative to open and close the valves, the at least one traveling or standing valve being modified to comprise a cylindrical housing, a tubular insert, releasably positioned within the housing, the insert having a fluid inlet end, a fluid outlet end, and a sidewall, the inlet end forming a valve ball stop and the sidewall forming at least one fluid port therethrough, a valve ball, and a valve seat, releasably positioned within the housing, wherein ball is sealingly received by the ball stop to plug the inlet end of the insert, creating a vacuum thereabove, and drawing fluids through the at least one fluid ports into the insert, and wherein ball is sealingly received by the valve seat to close the valve.

BRIEF DESCRIPTION OF THE DRAWINGS

Some of the embodiments will be described in detail, with reference to the following figures, wherein like designations denote like members, wherein.

DESCRIPTION

Figure 1A:
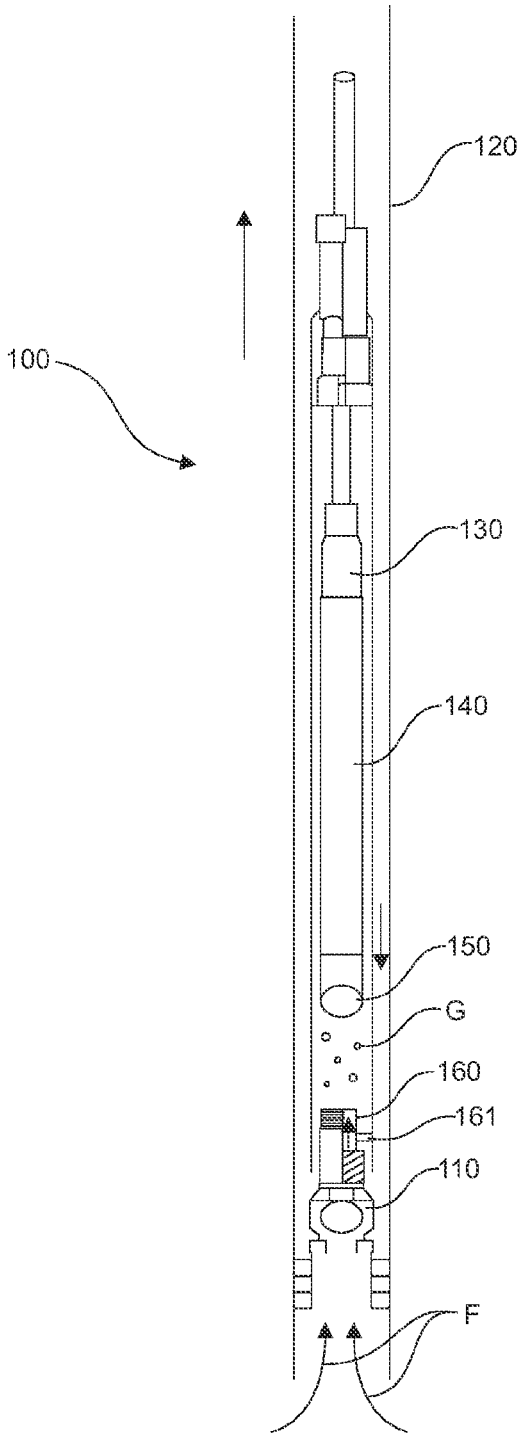
Fig. 1A RELATED ART
FIG. 1A is an illustration in cross section of a related art gas-lock breaking bushing (showing the pump in the upstroke)

According to embodiments herein, the present apparatus and methodologies may be may be operative for reducing or preventing gas locking/interference, enabling rapid resumption of liquid production, improving pump efficiency, and increasing production. System and pump maintenance may also be reduced through the elimination of damaging techniques such as 'tapping bottom' including, for example, the mitigation of damage to valve balls, cages and seats, and premature stuffing box failure. Rod life may be increased through the reduction in 'rod slap'.

According to further embodiments, the present apparatus and methodologies provides a pump valve that may be suitable for use as a standing valve, a travelling valve, or as a replacement for a three-wing case/spiral guide combination typically used at the top end of a hollow pull tube on hollow valve rod pumps. It is an advantage of the present technology that, when used as a standing valve, the present apparatus may also be used in combination with a vortex initiator.

By way of background, the present technology may be operative for use with reciprocating pump assemblies positioned within a standard wellbore. Having regard to FIGS. 1A and 1B (RELATED ART), reciprocating pump assemblies, such as a bottom hold-down pump 100, are commonly installed in conventional oil wells and comprise a standing one-way check valve 110, positioned on the bottom of a string of tubing pipe 120 in the liquid fluid near the bottom of the well, a traveling plunger or piston 130 in a hollow cylindrical barrel 140 just over the standing valve 110 with a traveling one-way check valve 150 in the piston 130, a sucker rod or pump rod extending from the piston to the wellhead on the surface, and an actuator (e.g. pump jack) connected to the rod for reciprocating the piston 130 and traveling valve 150.

Figure 1B:
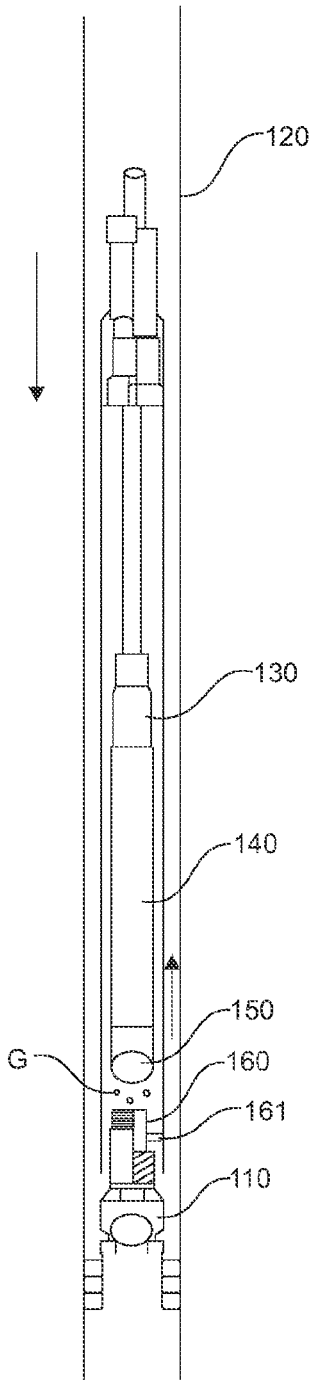
Fig. 1B RELATED ART
FIG. 1B is an illustration in cross section of the related art bushing shown in FIG. 1A (showing the pump on the down stroke)

FIG. 1A shows the conventional pump assembly in the upstroke, while FIG. 1B shows the same assembly in the down stroke. As would be understood, in operation, the bottom hold-down pump 100 operates by, during the upstroke, drawing or sucking fluid (F, arrows) through the standing valve 110 into the barrel 140. Then, on the down stroke, the piston 130 travels downwardly and the standing valve 110 closes to prevent fluid F in the barrel 140 from being pushed by the piston 130 back into the well. At the same time, the traveling valve 150 opens to allow the fluid F in the barrel 140 (above the standing valve 110) to flow through the piston 130 to a position in the barrel 140 above the piston 130. On the next upstroke, as the standing valve 110 is opened again, more fluid F is drawn into the barrel 140 under the piston 130, the traveling valve 150 in the piston 130 is closed to prevent the fluid F above the piston 130 from flowing back through the piston 130. In this manner, each successive stroke cycle of the piston 130 draws more fluid F from the reservoir to first position below the piston, and then to a position above the piston, eventually pumping the fluid F to the surface.

As described, many reservoirs produce excessive compressible fluids, such as gas, along with the non-compressible fluids (e.g. oil/water), which can cause problems for the pump 100. Such problems are commonly referred to as 'gas lock', or 'gas interference', and result from the gas G being drawn through the standing valve 110 into the barrel 140 on the upstroke. However, on the down stroke, when the standing valve 110 is closed, the non-compressible liquid is normally expected to force the traveling valve 150 open, gas G in the barrel 140 between the traveling valve 150 and the standing valve 110 will compress, allowing the hydrostatic head of the fluid above the traveling valve 150 from opening. On the upstroke, the gassy liquid caught above the standing valve 110 prevents any more fluid F from being drawn into the barrel 140 because the gassy liquid merely expands to fill the space in the barrel 140. As a result, the reciprocating pump strokes simply continue to alternate, compressing and expanding the gassy liquid trapped in the barrel 140, without pumping any liquid.

One attempt to address such gas-interference has been to incorporate a gas-lock breaker bushing 160. For example, the bushing 160 may be positioned within the barrel 140, between the traveling valve 150 and the standing valve 110. The bushing 160 may provide a gas-bleed port 161 through its side wall and may be operative to enable a controlled leak from the port. As such, during the down stroke, the movement of the piston 130 compresses the gas and forces it to bleed from the bushing 160. Gas continues to bleed until only fluid F remains, the traveling valve 150 then opens again to continue pumping the fluid F to the surface.

While known mechanisms for breaking gas-lock/gas-interference may be successful, such mechanisms suffer from numerous drawbacks (including as described above). For instance, gas G, with some entrained fluid F and even some solids, exit from the bushing 160 with high velocity, jetting against adjacent tubing causing damage to the tubing 120. Further, it is often the case that such bushings 160 cannot be removed or interchangeable, resulting in the system being restricted to its 0.032 inch opening, and being subjected to plugging of the bushing port by well debris.

Figure 2:
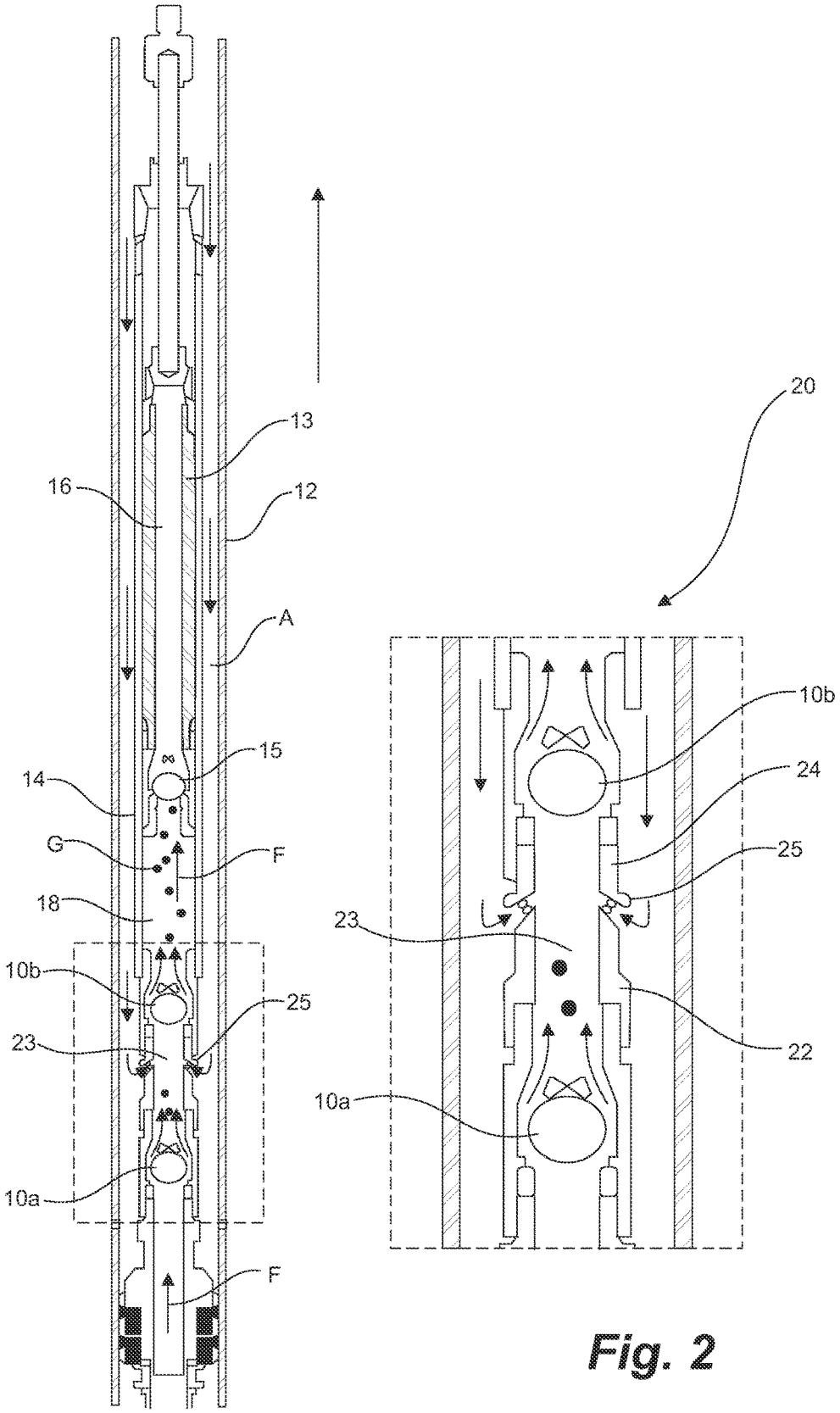
FIG. 2 is an illustration in cross section of the present apparatus according to embodiments herein showing the pump on the upstroke.
Figure 3:
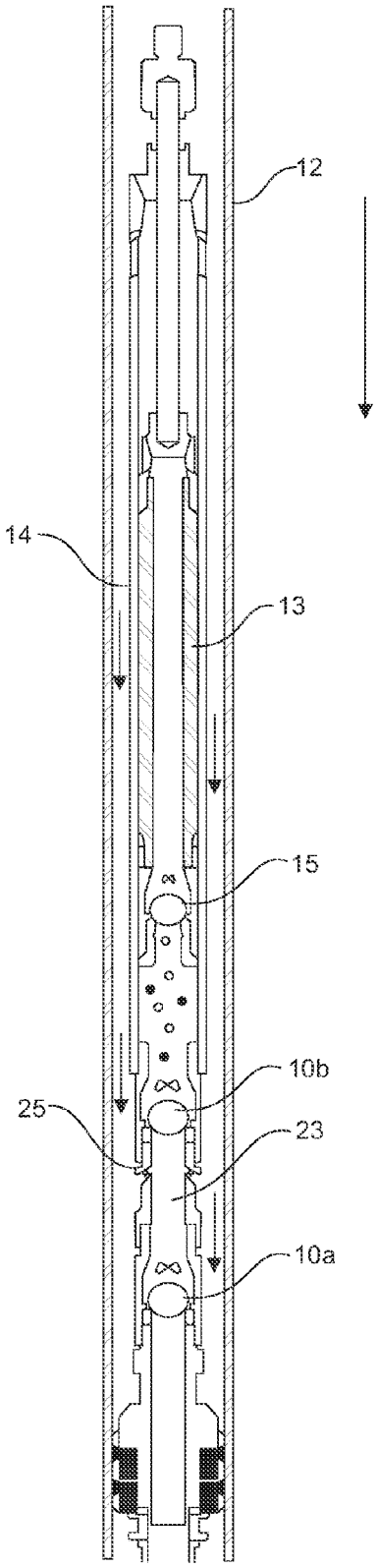
FIG. 3 is an illustration in cross section of the present apparatus shown in FIG. 2 showing the pump on the down stroke.
Figure 4:
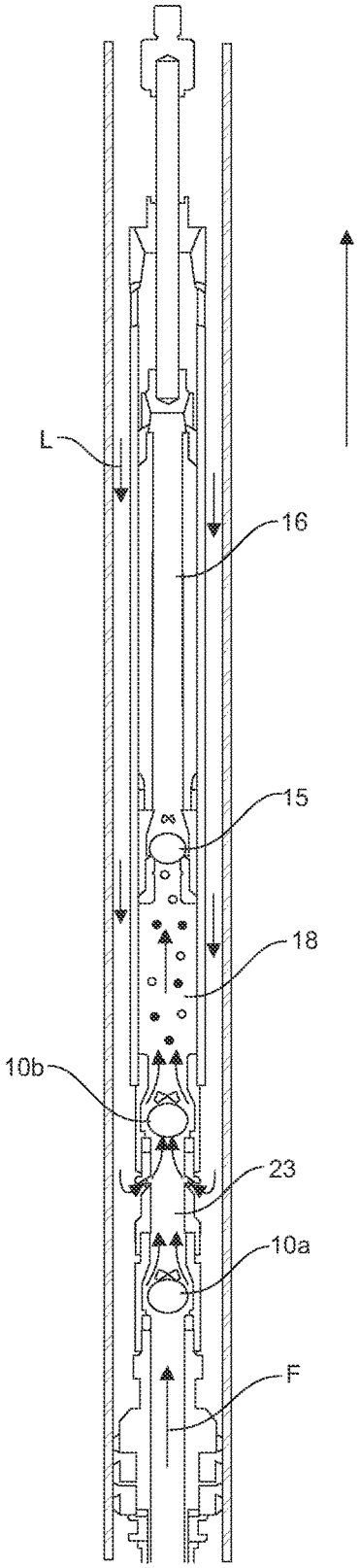
FIG. 4 is an illustration in cross section of the present apparatus shown in FIGS. 2 and 3 showing the pump on the subsequent upstroke.
Figure 5A:
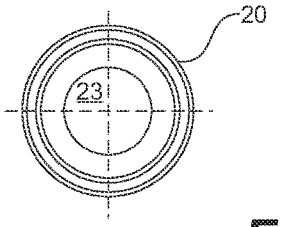
FIG. 5A is an illustration in cross section of the present apparatus.
Figure 5B:
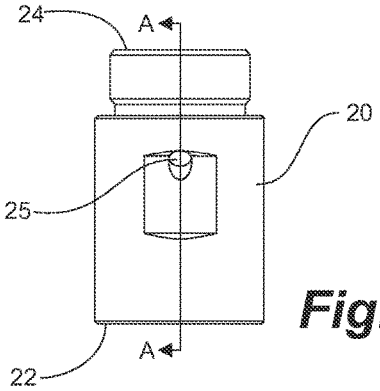
FIG. 5B is an illustration in side view of the present apparatus.
Figure 5C:
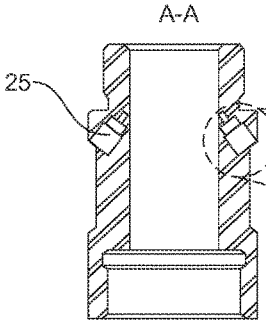
FIGS. 5C, 5D and 5E are illustrations in side cross-sectional view of the present apparatus showing the present bushing port (5C), an enhanced view thereof (5D), and a perspective view (5E)
Figure 5D:
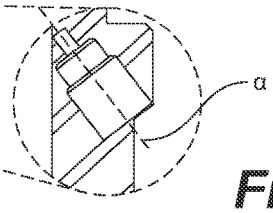
Figure 5E:
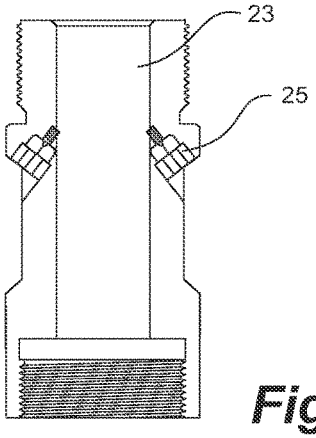
Figure 5F:
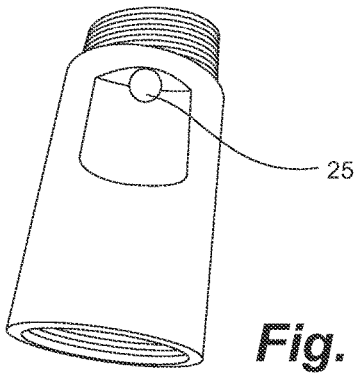
FIG. 5F is a perspective view of the present apparatus and port.

Having regard to FIGS. 2-4, the present apparatus and methodologies comprise may be utilized with a conventional downhole reciprocating pump, as described. For example, pump may comprise at least one standing valve 10, traveling piston 13 within cylindrical barrel 14, and at least one traveling one-way valve 15. The present apparatus may comprise a modified gas-lock reduction apparatus 20 and method of using same. Apparatus 20 may comprise a machined cylindrical bushing having a downhole inlet end 22 and an uphole outlet end 24, forming a bore 23 therebetween. Downhole end 22 may be configured for connection with the at least one standing valve 10*a* there below, such as, for example, by comprising a female threaded connection. Uphole end 24 may be configured for connection with the at least one second, otherwise standard, standing valve 10*b*, such as, for example, by comprising a male threaded connection. The entire apparatus 20 may be configured for positioning within a seating device installed in standard tubing 12.

As will be described in more detail below, the positioning of the present apparatus 20 between uphole and downhole standing valves 10*b*,10*a* enables controlled fluid communication between the annular space A (formed between the apparatus 20 and the tubing 12) and the bore 23, and between the bore 23 and the barrel 14. More specifically, the present apparatus 20 provides controlled 'leaking' of fluids from the annular space A into the bore 23 between the valves 10*a*,10*b*, the leaked fluid operative to reduce gas interference within the barrel 14. That is—large amounts of fluids injected into the substantial annular space A from the surface fill the space and give rise to significant hydrostatic pressure outside of the present apparatus 20, compared to the pressures within the apparatus 20, particularly in deeper wells. Controlled fluid flow from the annular space A into the apparatus 20 enables the fluids within the apparatus 20 to be subjected to the same hydrostatic pressures as fluids in the annulus A, ultimately reducing gas interference or gas lock therein. As such, it is an advantage of the present configuration that the bottom hold-down assembly sealing secures the present apparatus 20 within the tubing 12, sealing closing annular space A formed there between, preventing the pumped fluids F delivered to the annular space A from flowing back into the pump intake again. The bottom hold-down assembly further prevents any reciprocation motion of the barrel 14.

Bushing 20 may further comprise at least one vent or port 25 for providing fluid communication (e.g. forming fluid pathways) from bore 23 to the exterior of the bushing 20. In some embodiments, bushing 20 may comprise at least one port 25. In other embodiments, bushing 20 may comprise at least two ports 25, the ports 25 being diametrically opposed from one another. In other embodiments, bushing 20 may comprise a plurality of ports 25, the ports 25 being radially spaced around the circumference of the bushing 20.

Having regard to FIGS. 5A-5F, ports 25 may be machined such as to be directed at an angle from the longitudinal axis of the wellbore (and pump 100). For example, ports 25 may be angled at least between 10-80° from the axial plane of bore 23. That is—ports 25 may be provide at an angle of at least 10° and less than 80°, and preferably at an angle of approximately 45° from the longitudinal axis of bore 23 (α, FIG. 5D). In some embodiments, ports 25 may be oriented at a direction generally outward from bore 23, and generally downhole and/or uphole from bushing 20. In some other embodiments, ports 25 may be oriented at a direction generally perpendicular to the longitudinal axis of the pump, or bore 23.

Having further regard to FIGS. 5A-5F, according to embodiments herein, ports 25 may be configured such that the internal diameter of the port may be adjusted. For example, ports 25 may be configured to receive a tubular insert, such as a carbide insert, enabling the size of the port 25 to be increased or decreased with the insertion or removal of the insert. Inserts may be readily available for use in different port 25 sizes, e.g. from the standard 0.032 inch opening to a customized size for a particular field requirement. Different port 25 sizes may be required depending upon the depth of the well and pump bore sizes. Use of replaceable carbide inserts in ports 25 allows for easy removal, maintenance, or replacement of inserts, rather than having to replace the entire bushing 20, reducing repair costs. Although it is an advantage of the present apparatus 20 that the size of the apparatus 20 may be adapted to all sizes of production tubing, such as between being 2⅜", 2⅞", and 3½", and that the internal diameter of the ports 25 therein may also be adapted (as described), a skilled person would appreciate that the apparatus 20 may have non-replaceable components, or integrated ports 25 without affecting the gas interference reduction functionality.

According to embodiments herein, as shown in FIG. 2, the internal volume of barrel 14 is divided by traveling valve 15 into an upper barrel chamber 16 above the traveling valve 15, and a lower barrel chamber 18, below the traveling valve 15. Upper and lower chambers 16,18 are in controllable fluid communication with each other through traveling valve 15, where lower chamber 18 operates as a displacement chamber. Bore 23, between standing 10*a*,10*b*, forms an additional chamber. As such, the flow of fluids F from the reservoir into bore 23 is controlled by downhole standing valve 10*a*, while the flow of fluids F from bore 23 into displacement chamber 18 is controlled by uphole standing valve 10*b*. Fluid flowing down annulus A is received by at least one ports 25 of bushing 20.

Generally, in operation, on the upstroke (FIG. 2), piston 13 moves upwardly (e.g. travels uphole), decreasing the pressure in the lower chamber 18 of the barrel. If there is little or no gas G in the lower chamber 18, then the pressure therein is decreased sufficiently to actuate the traveling valve 15, closing the valve, due to the higher hydrostatic pressure of the fluids in the upper chamber 16. Both standing valves, 10*a*,10*b*, open due to the low pressure formed in the lower chamber 18 (opens valve 10*b*) and the higher pressure in the reservoir applied from downhole (opens 10*a*). Opening of both standing valves 10*a*,10*b*, draws reservoir fluids F (arrows) into the barrel 14. In addition, bore 23 receives 'leaking' fluid from the annular space A, via ports 25, for transport to barrel 14. The hydrostatic pressure of the leaked fluid from the annular space A acts upon the uphole standing valve 10*b*, assisting to force the ball off the seat, opening the valve and filling lower chamber 18 of the barrel 14. As such, during the upstroke, free gas G may enter the displacement chamber, or solution gas may break out of the fluids F in displacement chamber 18 due to the pressure decrease therein.

On the subsequent down stroke (FIG. 3), piston 13 moves downwardly (e.g. travels downhole). The gas G in the displacement chamber 18 is compressed, resulting the traveling valve 15 remaining closed due to the higher hydrostatic pressure of the fluids F in the upper chamber 16. With the compression of gas G in the lower chamber 18, the pressure therein increases. At the bottom of the down stroke, the hydrostatic pressure in the upper chamber 16 above the traveling valve 15 becomes the same as that in the annular space A.

As shown in FIG. 4, on the subsequent upstroke, piston 13 travels uphole, decreasing the pressure in the lower chamber 18. In a conventional pump, as gas in the lower chamber 18 expands, the pressure decrease in the lower barrel 18 is smaller than that when no gas G is in the lower barrel 18, thus tending to be insufficient to permit the uphole standing valve 10*b* to open. However, when the present apparatus 20 is installed, two upward forces are applied at the uphole standing valve 10*b* to open same. A first upward force is from the pressure that already exists in the bore 23 from the reservoir through the downhole standing valve 10*a*, which is applied to the downhole side of the uphole standing valve 10*b*. While the first upward force itself may not be sufficient to open the upper valve 10*b*, a second upward force from the hydrostatic pressure of the liquid injected from the surface into the annular space A is also applied to the downhole side of the uphole valve 10*b*. This second pressure is applied via fluid flowing from the annular space A through ports 25 into bore 23. Specifically, the hydrostatic pressure of the liquid in the annular area A exerts pressure, causing a small increment of liquid to enter ports 25 into bore 23. As the piston 13 travels uphole, the pressure in the displacement chamber 18 further decreases to a point when the first and second forces overcome the pressure above the upper standing valve 10*b*, opening the valve 10*b*. Then, fluid in the bore 23 between the two standing valves 10*a*,10*b*, as well as a squirt of liquid from the annular space A through ports 25, enters the lower displacement chamber 18.

With the introduction of liquid from the annular space A into lower chamber 18, the lower chamber 18 may then have sufficient incompressible fluids F therein such that, on the next down stroke, the traveling valve 16 is opened. Alternatively, if the lower chamber 18 does not have sufficient incompressible fluids F therein after an upstroke, then the introduction of incremental liquid from the annular space A into the lower chamber 18 continues on subsequent upstrokes until, eventually, after several reciprocations, the fluids F in the lower chamber 18 accumulates to a sufficient amount to open the traveling valve 15 on a down stroke. Further, on the down stroke, the uphole standing valve 10*b* closes and prevents a sustained jetting of fluid F through ports 25 (with the exception of an extremely small volume that is enough to flush said ports 25, prior to the closing of the uphole standing valve 10*b*, but is not enough to cause erosive damage to the tubing 12). When the traveling valve 15 opens, and fluids F in the bore 23 and lower chamber 18 are pumped uphole, decreasing the pressure in the bore 23 to lower than that of the reservoir, causing, on the next upstroke, the downhole standing valve 10*b* to open and draw more fluids F from the reservoir. It would be understood that the present apparatus and methodologies serve to overcome gas interference (or gas lock) conditions in the pump.

According to embodiments herein, it is an advantage of the present apparatus 20 that the uphole standing valve 10*b* may open on every upstroke, thus continually introducing fluids F into the pump. Moreover, the present apparatus 20 restricts the flow of liquid from the annular space A into bore 23, preventing the discharge of fluids F into the annular A (with the exception of a minute volume to flush ports 25).

It would be understood that the present apparatus 20 may be a separate component from the standing valves 10*a*,10*b*. Alternatively, it would be understood that, rather than separate components, the present apparatus 20 may be manufactured integral to the uphole standing valve 10*b*, for coupling between the traveling valve 15 and a conventional standing valve therebelow, or integral to the downhole standing valve 10*a*, for coupling below a conventional standing valve thereabove. In one embodiment, the present apparatus 20 may be manufactured to be integral with, and sandwiched between, two standing valves 10*a*,10*b*, and manufactured as a single apparatus for replaces a conventional standing valve.

Figure 6:
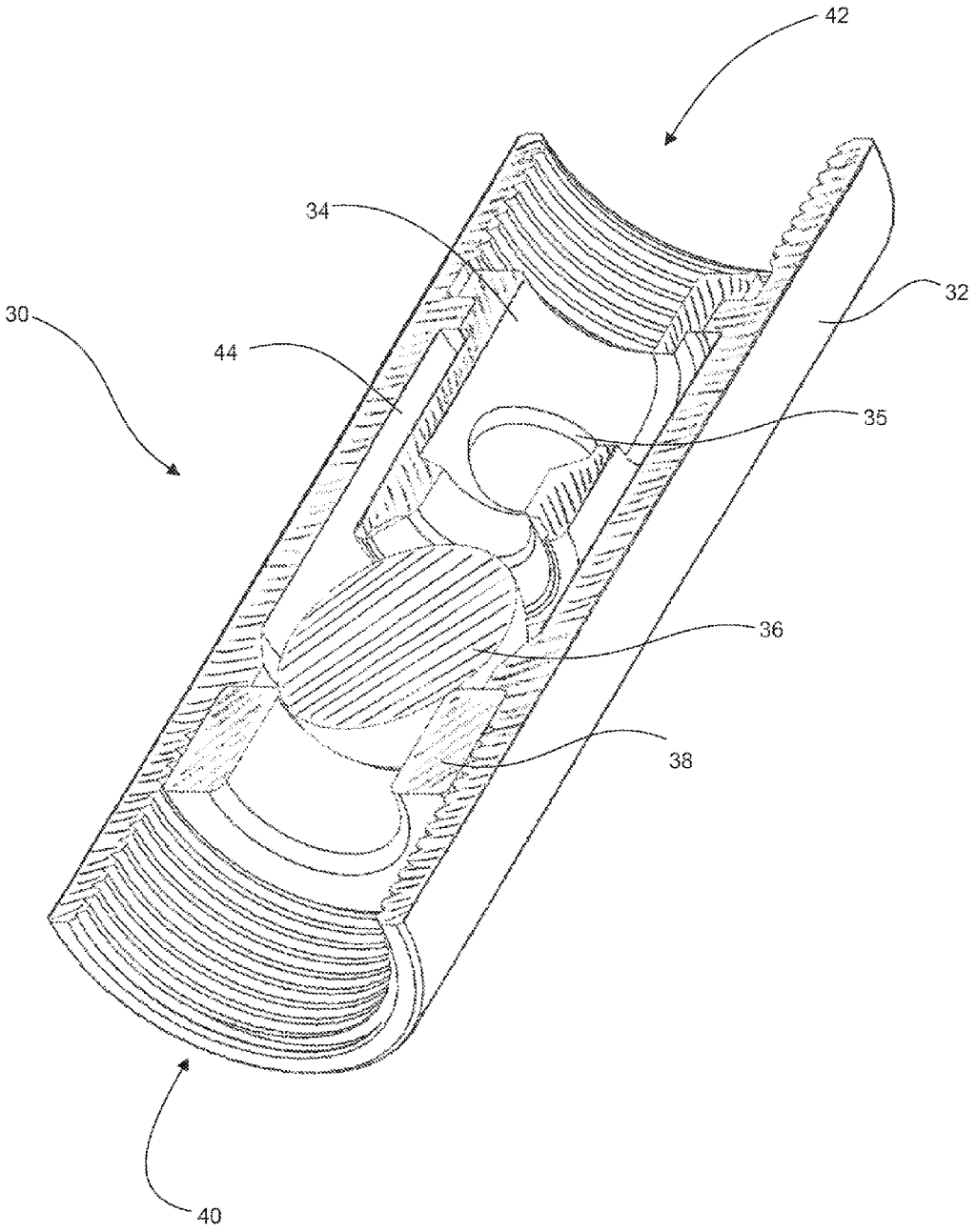
FIG. 6 is a perspective cross-sectional view of a pump valve according to embodiments herein (showing the ball seated in the valve seat)
Figure 7:
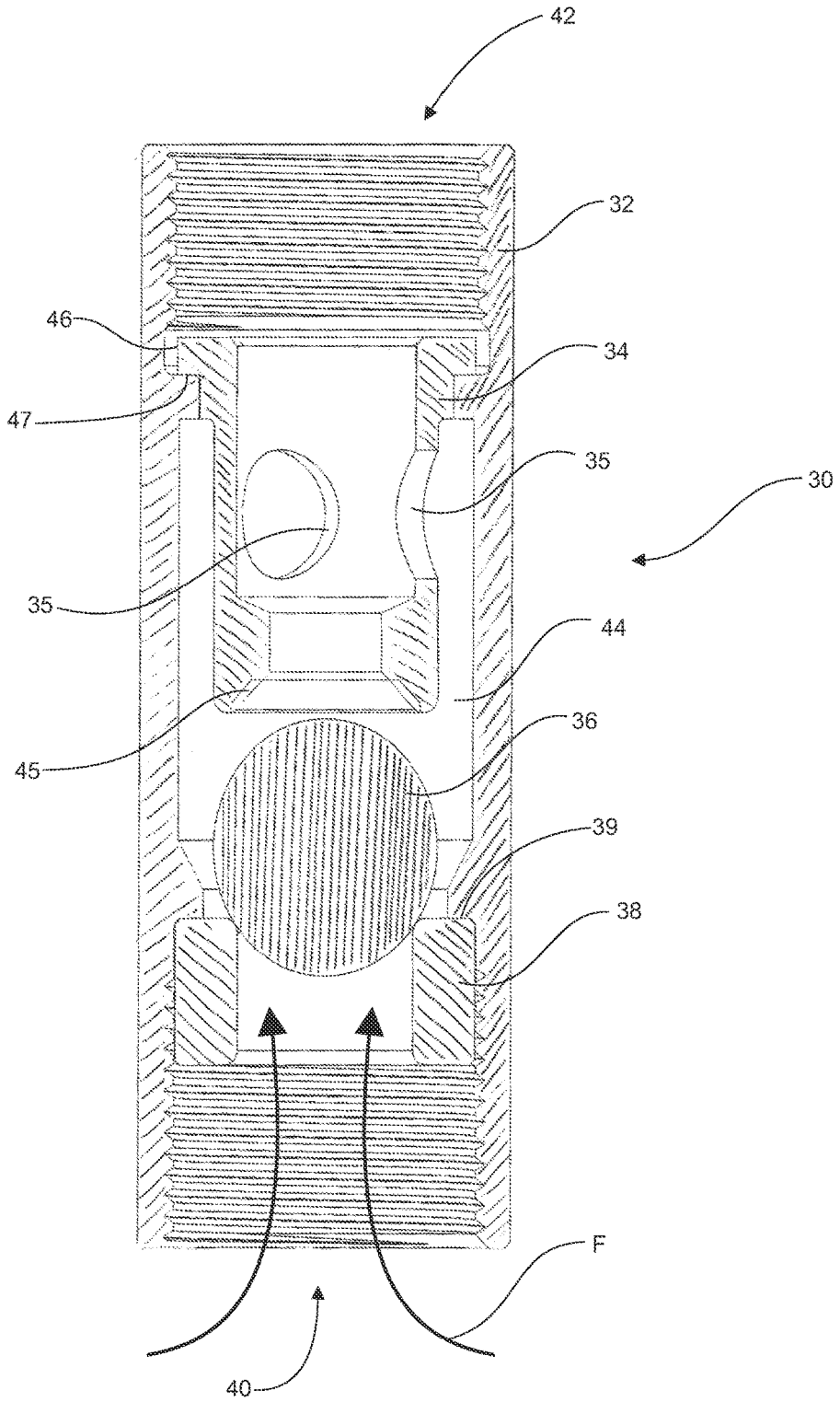
FIG. 7 is a cross-sectional side view of the valve shown in FIG. 6.

According to embodiments herein, as shown in FIGS. 6 and 7, the present apparatus may be configured to comprise valve 30 having housing 32, tubular insert 34, a conventional valve ball 36 and seat 38. Valve components may be composed of any appropriate materials, such as stainless steel, and alloy or some other material capable of withstanding the conditions present in typical oil well environments, and may be coated, for example nickel spray coated.

In some embodiments, valve 30 may be used as a traveling valve, such as traveling valve 15 described herein. In such a case, valve 30 may comprise inlet 40, outlet 42, and bore 44 there between. Valve seat 38 is carried by housing 32 at or near inlet 40, while insert 34 is carried by housing 32 at or near outlet 42. Valve ball 36 may be disposed between seat 38 and insert 34. It would be understood that any appropriate connection means for connecting seat 38 and insert 34 to housing 32, such as threaded connections, are contemplated. Further, it would be understood that any appropriate connection means for connecting valve housing 32 to a pump plunger or piston, such as piston 13, thereabove, and components therebelow, such as bushing 20, are contemplated. Further, and in contradistinction with known cage-type ball valve structures, ball 36 is not constrained radially by restrictive structure and instead is axially movable through a large cross-sectional flow area within housing 32.

As is shown in FIG. 7, at its downhole end, insert 34 may form ball stop 45, correspondingly sized to receive ball 36 therein. In one embodiment, stop 45 comprises edges, the edges being concave or otherwise inwardly angled for guiding ball 36 into the centre of the stop 45, blocking the inlet of the bore formed within tubular insert 34 (i.e. effectively plugging the inlet). In some embodiments, stop 45 may comprise a hemi-spherical socket configuration that is adapted to correspond to the size and shape of the ball 36, holding the ball 36 therein. More specifically, stop 45 may accommodate the exact circumferential dimension of the ball 36. Stop 45 may further be configured to provide one or more ball guides (not shown), radially spaced around the internal surface of stop 45, for further securing ball within stop 45. Guides may or may not be configured to further create a vortex of fluid around the ball 36. Stop 45 may be fitted with a welded and finished/polished inlay of Stellite, or some other such hardening or treatment.

As is further shown in FIG. 7, at its uphole end, insert 34 may form flange 46, for abutting inner shoulder 47 of housing 32. It should be appreciated that inner threads within housing 32 may be threadingly engaged with piston 13, said piston 13 serving to secure tubular insert 34 in position. Such threading engagement of the piston 13, valve 30 and valve components, such as insert 34, enable the valve 30 to be removed and repaired, or replaced as necessary. Tubular insert 34 may form at least one port radially spaced about the circumference of the insert 34, and preferably may form at least three ports 35. Each port 35 may or may not have the same diameter.

Valve seat 38 may be positioned within housing 32, and may be a conventional rod pump valve seat. As shown in FIGS. 6 and 7, seat 38 may be inserted into housing 32 such that it abuts inner shoulder 39 of housing 32. Seat 38 may be manufactured from tungsten carbide, or some other material capable of withstanding oil well environments. Inner threads on housing 32 may be used to threadably engage housing with a conventional seat plug (not shown), the plug being operative to hold the seat 38 in place in the bore of the housing 32.

Valve ball 36 may be a conventional ball, although smaller than those used in conventional pump valves, and would be well known in the industry. For instance, use of smaller valve balls provides more clearance and a greater flow area through the valve, where use of a smaller ball in a known valve or cage could lead to premature wear due to turbulent flow resulting from the larger flow area, leading to uncontrolled movement of the ball in the valve cage, or rattling.

When valve 30 is used as a traveling valve, such as valve 15, and the piston 13 begins into the down stroke, ball 36 responds to a decrease in pressure within the housing 32 (relative to valve inlet 40) and moves towards ball stop 45. As a result, fluids (F, arrows) travel into the valve inlet 40, around the ball 36, and into the bore 44 of housing 32, that is—into the annular area formed between the inside of the valve housing 32 and the outside of the ported insert 34. Fluids F then flow into the bore of the insert 34, via ports 35, and out of the uphole end of the insert 34 into the barrel 14.

During this time, valve ball 36 is received and held within the ball stop 45. Ball 36 is actuated into this position because present valve design creates flow dynamics that generate a vacuum above the ball 36 in the bore of the insert 34, aiding to keep the ball 36 in its unseated position and preventing uncontrolled movement thereof. As the ball 36 is held in position against the ball stop 45, fluid F passes freely and around the ball 36 with ease.

While the ball 36 is lifted and held in position against ball stop 45, any violent action of the ball 36 or 'ball rattling' is eliminated, thereby obviating a need for a hard liner or longitudinally extending ribs, or races to be included in the valve cage, unlike typical known valve cages. Such a configuration further prevents premature damage to the seat 38, and premature valve leakage as a result of uncontrolled up and down movement of the ball 36, as may be the case with standard API valves. The flow dynamics about the periphery of the ball 36 and the axial spacing of the ball stop 45 from the valve seat 38 may further be configured to minimize ball rattle.

On the upstroke, fluid flow and gravity acts on ball 36, increasing pressure above the valve 30 and causing ball 36 to drop from stop 45. The ball 36 drops axially or straight down from the stop 45, falling onto seat 38 therebelow and blocking reverse flow of fluid through the valve 30.

As would be known, known hard-lined ball cages with their ribbed structure and their close tolerances between the inside of the cage and the outside of the ball (e.g., see U.S. Pat. No. 6,830,441) can lead to solids eventually wedging themselves against the ball, thereby preventing the ball from reseating. It is an advantage of the present technology that valve 30 eliminates the use of cages or longitudinally extending ribs, significantly increasing the clearance between the ball 36 and the closest adjacent surface (the radially-spaced inside of the housing). With this larger clearance, solids are less likely to become lodged, to accumulate around the ball 36, or to be stacking up during pumping operations and reducing the efficiency of the pump.

Known attempts to minimize ball rattling by reducing the clearance between the ball and the valve body (e.g., see U.S. Pat. No. 6,899,127) increases friction between the fluid, the valve ball and the valve body, thereby dissipating the kinetic energy of the flowing fluid and increasing the pressure drop across the valve. It is an advantage of the present technology that valve 30 provides a shorter distance between valve seat 38 and ball stop 45, without sacrificing flow area and the problems associated therewith. Thus, valve 30 can have a flow area that is sufficiently large that there is little or no reduction in kinetic energy or a resulting increase in pressure drop. Valve 30 may further be capable of creating faster seating of the ball 36 within the seat 45 on the up-stroke, reducing pump stroke loss and providing for more efficient pumping.

Figure 8:
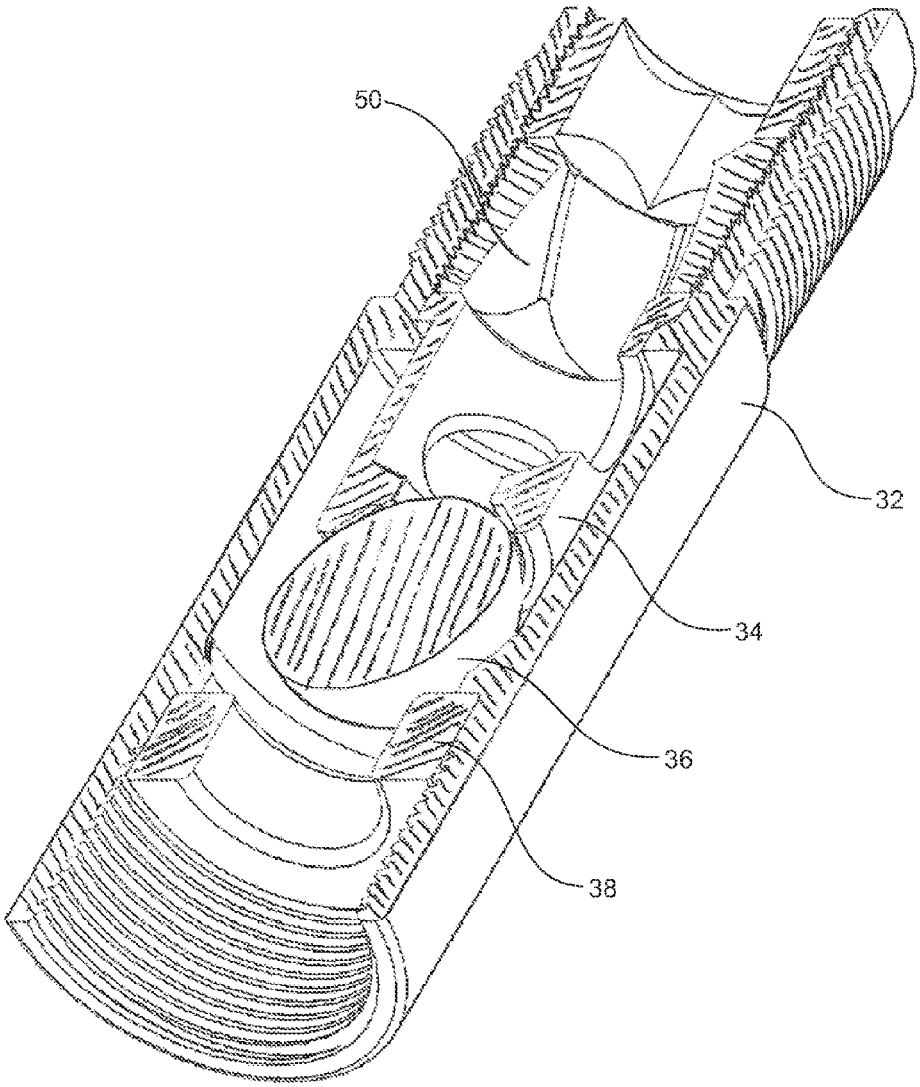
FIG. 8 is a perspective cross-sectional view of the pump valve according to FIG. 6 further comprising a vortex initiator, and showing the ball positioned in the ball stop.
Figure 9:
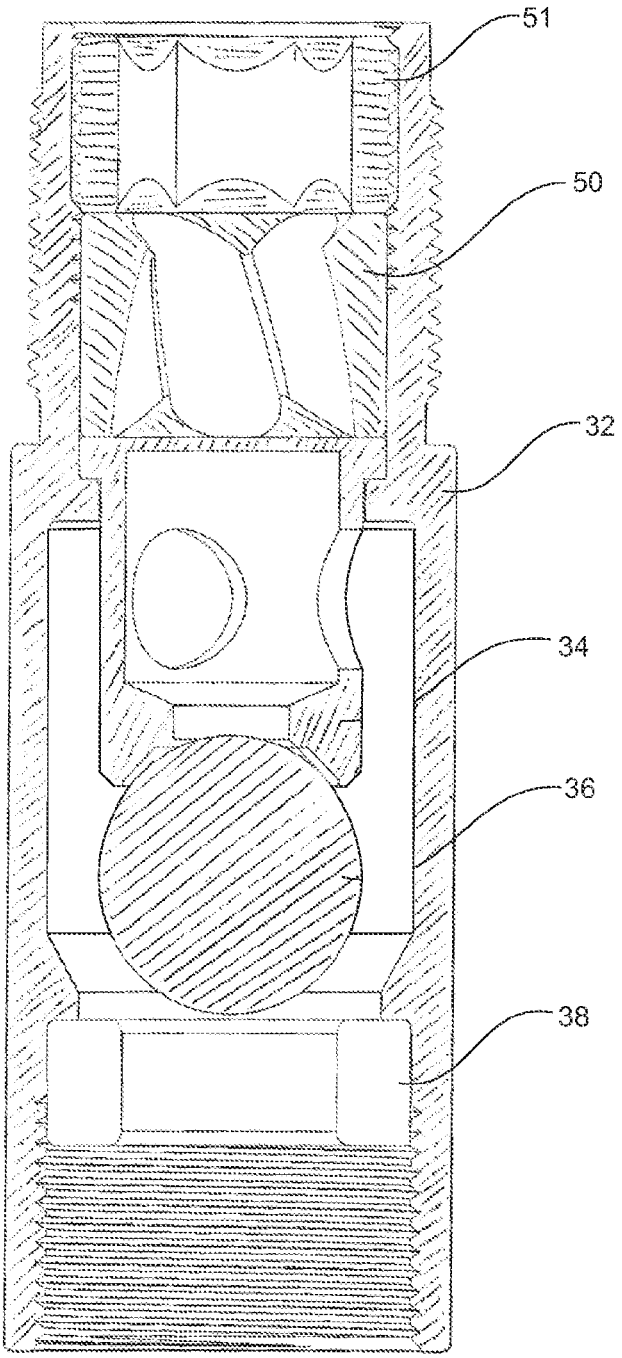
FIG. 9 is a cross-sectional side view of the valve shown in FIG. 8.

Having regard to FIGS. 8 and 9, when the valve 30 is used as a standing valve, such as valve 10, a vortex initiator 50 may also be used. In some embodiments, the use of initiator 50 may be preferred when valve 30 is used as a standing valve. In such a case, the upper part of housing 32 may be modified to provide outer threads, for threadably engaging housing 32 with barrel 14, while inner housing threads at the downhole end of housing 32 may be used to threadably engage housing to a hold-down seal assembly and/or a conventional seat plug (not shown) to hold the valve seat 38 in place.

Figure 10:
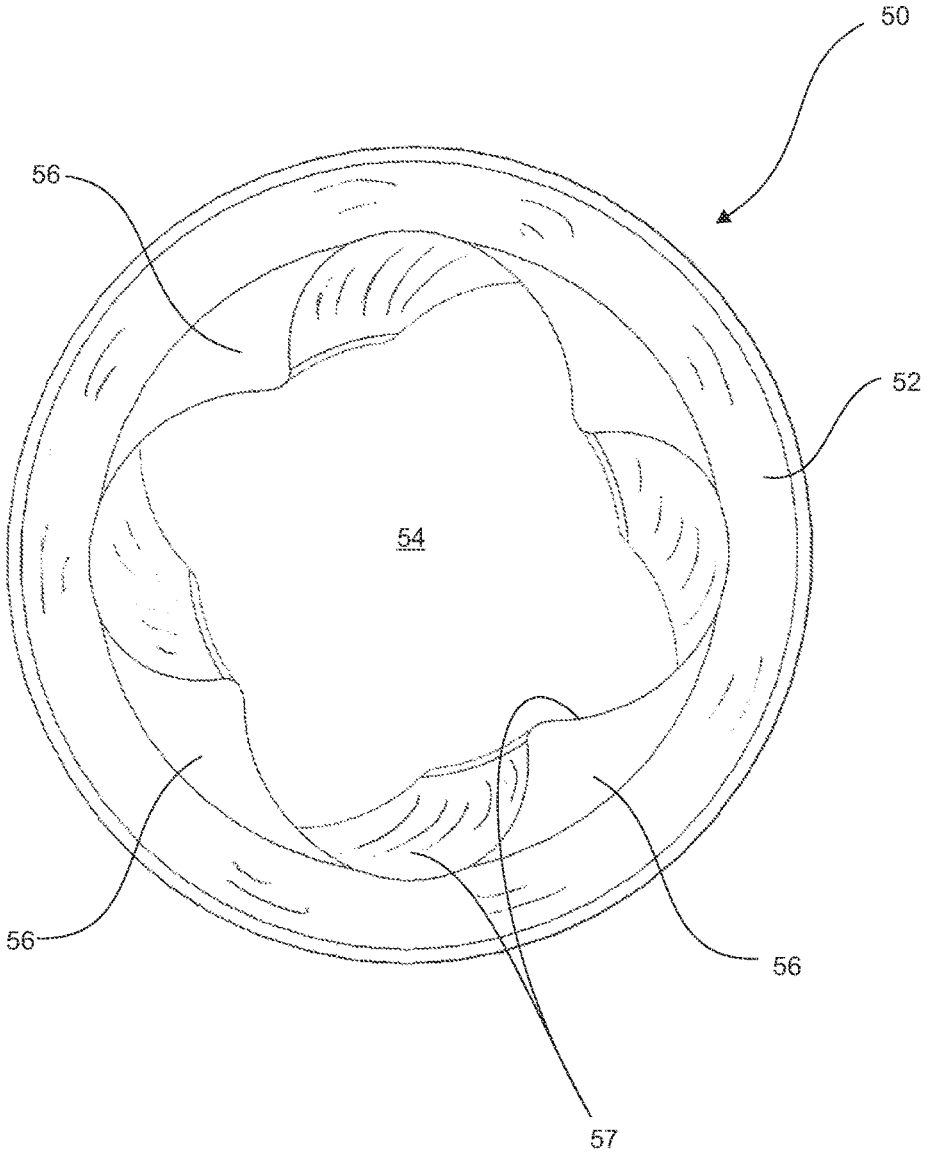
FIG. 10 is a top view of the vortex initiator shown in FIGS. 8 and 9.

Vortex initiator 50 may be positioned within housing 32 at or above insert 34. Lock nut 51 may then be positioned (e.g. threaded) in housing 32 to hold the vortex initiator 50 and insert 34 in place in bore 44. Vortex initiator 50 may comprise a tubular structure having a top end and a bottom end, and a flow passage there between. As shown in FIG. 10, the vortex initiator comprises a circular housing 52, central bore 54, forming a flow passage, and inwardly extending flanges 56. Flanges 56 each comprise two surfaces 57 that are helically directed, creating a vortex in the fluid F as it flows through bore 54.

According to embodiments herein, vortex initiator 50 may enhance fluid F flow by causing the fluid to move faster. This is achieved because the fluid F enters into a spin as it exits the vortex 50, resulting in better pump fillage. That is—the radial design of the vortex initiator 50 allows for faster fluid passage with greater flow capacity, forcing solids within the fluid F away from valve seat 38. As a result, the ball seats with less interference from debris which results in a longer run life for the valve ball 36 and valve seat 38.

When used as a standing valve, as the piston 13 begins into the down stroke, ball 36 moves towards valve seat 38 in response to an increase in pressure above the valve ball 36. The flow of fluid through the valve is blocked. On the subsequent upstroke, the ball 36 moves directly towards ball stop 45 at the bottom of the insert 34, in response to a decrease in pressure within housing 32 relative to pressure at the valve inlet 40. Fluid F travels into the valve inlet 40 from the reservoir, around the ball 36, and into the annular area 44, as described above. Fluid then flows into insert 34, via ports 35, and then out of the insert 34 through the vortex initiator 50 and into the barrel 14.

Figure 11:
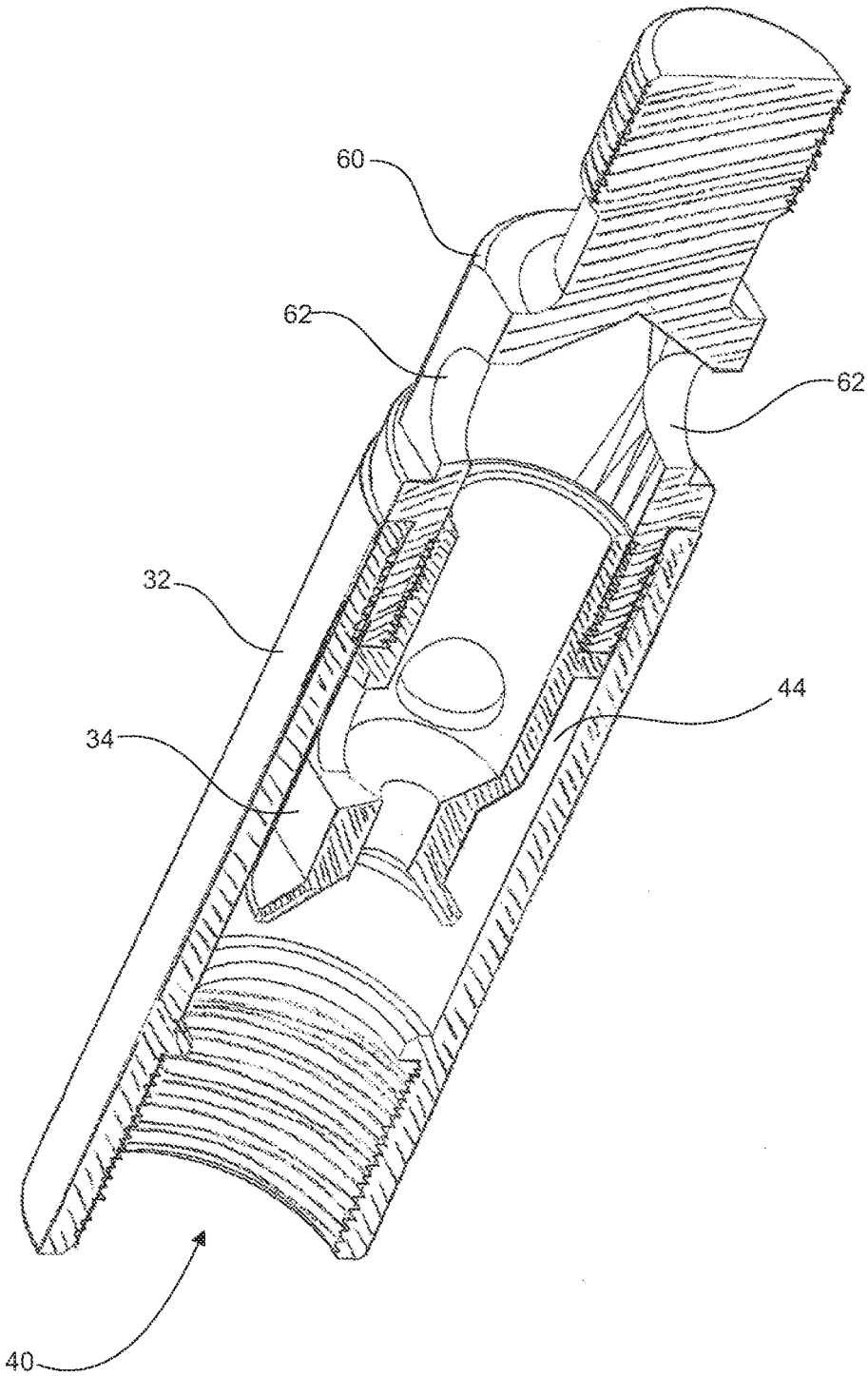
FIG. 11 is a cross-sectional perspective view of a pump valve according to embodiments herein, the valve being used in combination with a ported rod connector.
Figure 12:
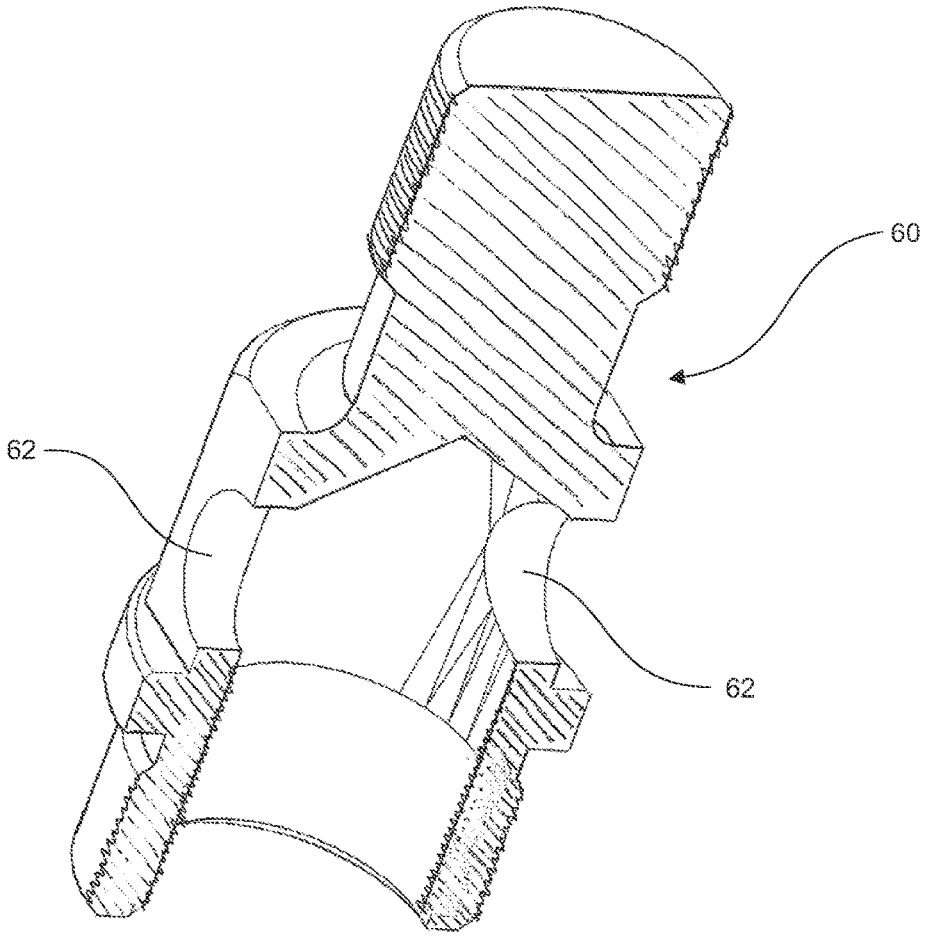
FIG. 12 is a cross-sectional perspective view of the rod connector, according to a first embodiment, as shown in FIG. 11.

Having regard to FIGS. 11 and 12, when the valve 30 is in conjunction with a top-ported rod connector, a ported rod connector 60 may be used. The valve 30 and rod connector 60 may be used as replacement for a top three-wing cage/spiral guide combination, commonly used on hollow valve rod pumps or hollow pull tube pumps. Hollow valve rod pumps are commonly used for deep wells to overcome the problem with solid valve rods connected to the plunger having a tendency to buckle during the down-stroke due to compressive loads operating there, creating friction between the valve rod and valve rod guide and between the barrel and the plunger. Also the addition of the top valve to these pumps has been known to have some benefits, known to those in the industry, for gassy wells.

Figure 13:
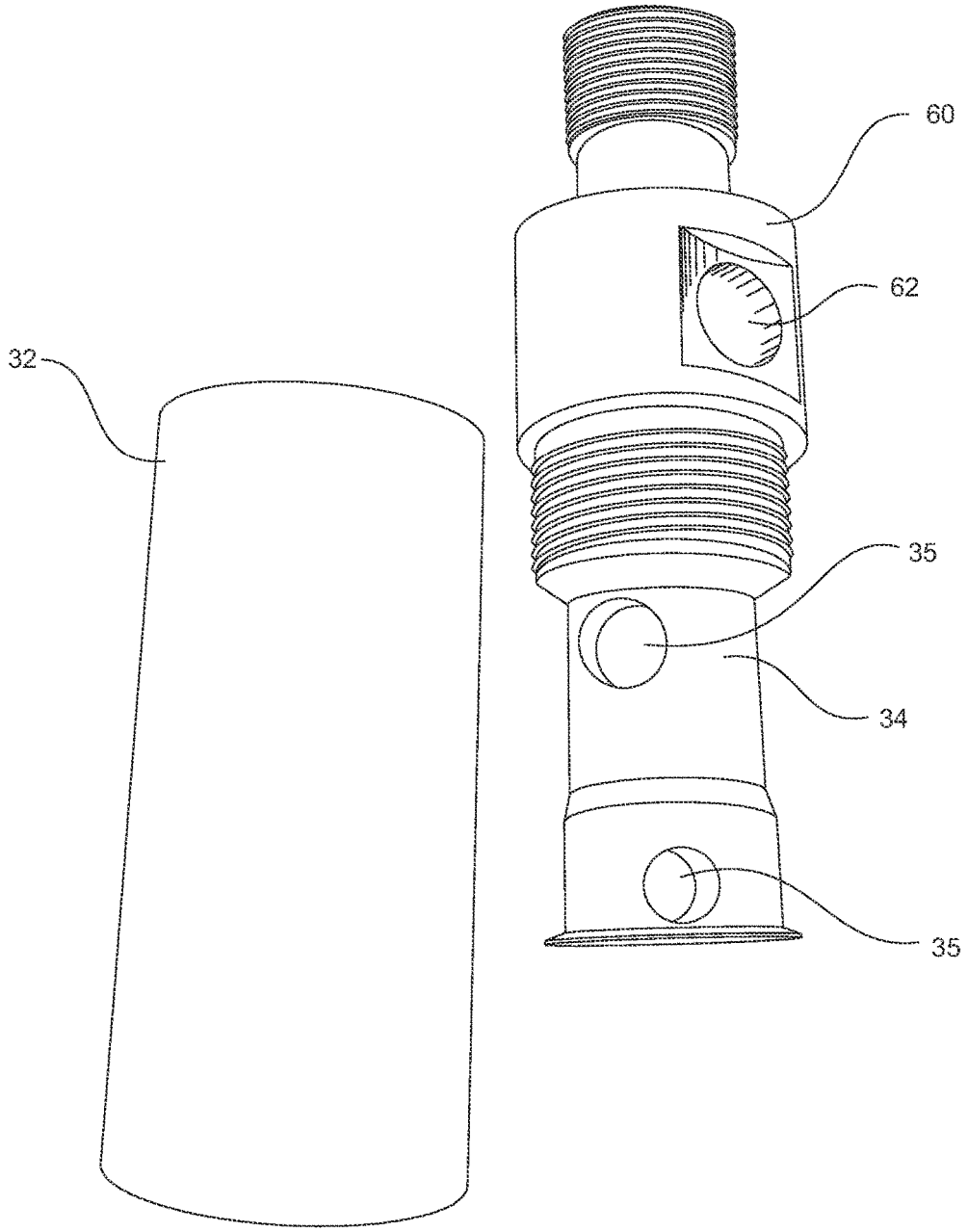
FIG. 13 is a perspective side view of the rod connector according to a second embodiment.

As shown in FIG. 11, the top-ported rod connector 60 comprises a fluid inlet that is in fluid communication with the fluid outlet of insert 34 and ports 35, allowing fluids F to enter connector 60 from insert 34, and to exit connector 60 via ports 62, into the annular space A of the tubing 12. In one embodiment (shown in FIG. 12), connector 60 comprises connection means (e.g. external threads) for connecting with housing 32. Connector 60 further comprises connection means (e.g. internal threads) for connecting with insert 34, aiding to hold insert 34 in place within the housing 32. Finally, connector 60 may connection means (e.g. external threads), at its upper end, for connecting to a sucker rod (not shown). In such a case, housing 32 may be adapted to a hollow valve rod, which may also hold the valve seat 38 in place. It would be understood that housing 32 may be coated, for example with a nickel spray coating, to harden it. Having regard to FIG. 13, it would be appreciated that insert 34 and connector 60 may integral to one another, and may vary in size shape and the number of ports 35, 61, respectively.

Although the hollow valve rod replacement to the solid valve rod solves a great deal of the problems associated with buckling as described above, there can still be some buckling particularly on deep wells. This buckling can still force a conventional top, three-wing cage valve over to the side of the tubing as the rod bends due to compressive forces. The valve with its sharp edges can rub on the tubing causing premature wear. One solution is to add a spray metal spiral guide to the top of the three-wing cage valve which reduces wear and by its design will last much longer than the three-wing cage itself. The problem with the spray metal spiral guide/three-wing cage is there are a number of edges that can still cause wear on the tubing. The present valve/rod connector provides advantages over known three-wing cage valve/spiral guide combinations. The cost for the valve/ported rod connector is lower, there is less wear of the tubing as a result of the smooth one piece spray metal coated surface. The valve housing is coated with a hardening process, which may be nickel spray metal, or some such other hardening process to reduce friction and enhance valve life. The valve/ported rod connector will come pre tightened or factory tightened, as a one piece add on, versus the two three-wing cage valve and spiral guide components, which can be subject to human error on under tightening.

In operation, when used with the ported rod connector 60, and in response to decrease in pressure within the valve body relative to pressure at the valve inlet 40, the valve ball 36 moves towards ball stop 45 at the bottom of insert 34. Fluid F travels into the valve inlet 40, around the ball 36, and into the bore 44. Fluid then flows into the insert 34, via ports 35, out of the insert 34 into flow passage of the rod connector 60 and out through ports 61 and into the annulus A of the tubing 12. On the upstroke, ball 36 drops from ball stop 45 onto seat 38, blocking reverse flow of fluid through the valve 30.

While the pump valve has been described in conjunction with the disclosed embodiments and examples which are set forth in detail, it should be understood that this is by illustration only and this disclosure is not intended to be limited to these embodiments and examples. On the contrary, this disclosure is intended to cover alternatives, modifications, and equivalents which will become apparent to those skilled in the art in view of this disclosure.

For the sake of clarity, it is to be understood that the use of 'a' or 'an' throughout this application does not exclude a plurality, and 'comprising' does not exclude other steps or elements.

The claims are as follows:

1. A modified pump for reducing gas interference in the pump positioned in a subterranean wellbore, the pump having a cylindrical barrel and a longitudinal axis, comprising:

at least one traveling valve;

at least one reciprocating piston operative to open and close the at least one traveling valve;

at least two standing valves and at least one cylindrical bushing, the at least one cylindrical bushing having a sidewall forming a fluid bore and positioned between the at least two standing valves, wherein the at least one cylindrical bushing having a downhole end, the downhole end being in fluid communication with a downhole one of the at least two standing valves for receiving fluids drawn from the wellbore into the fluid bore;

an uphole end, the uphole end being in fluid communication with an uphole one of the at least two standing valves for transporting fluids received within the fluid bore to the cylindrical barrel; and at least one fluid port, extending through the sidewall of the cylindrical bushing, for directing fluids from the annulus of the wellbore into the fluid bore to increase the hydrostatic pressure of the fluids within the fluid bore and to reduce gas interference therein, enabling opening and closing of the traveling valve upon reciprocation of the piston, wherein the at least one standing valve is in fluid communication with a vortex initiator.

2. The modified pump of claim 1, wherein the cylindrical bushing comprises at least two fluid ports.

3. The modified pump of claim 2, wherein the at least two fluid ports are diametrically opposed from one another.

4. The modified pump of claim 1, wherein the cylindrical bushing comprises a plurality of fluid ports, radially spaced around the circumference of the bushing.

5. The modified pump of claim 1, wherein the at least one fluid port provides fluid pathways angled at between 10-80° from the longitudinal axis of the pump.

6. The pump of claim 5, wherein the at least one fluid port provides fluid pathways angled at approximately 45° from the longitudinal axis of the pump.

7. The modified pump of claim 1, wherein the apparatus further comprises at least one insert for positioning within the at least one fluid ports, decreasing the internal diameter thereof.

8. The modified pump of claim 1, wherein the at least one traveling valve is a modified traveling valve comprising a housing, a ported tubular insert, a valve ball and seat.

9. The pump of claim 1, wherein the pump further comprises a rod connector, releasably positioned within the housing, in fluid communication with the outlet end of a tubular insert.

10. The pump of claim 9, wherein the rod connector may form at least one fluid port for directing fluid from the valve to the annular space.

11. A method of reducing gas interference in a reciprocating pump for recovering reservoir fluids from a subterranean reservoir, the method comprising:

sealingly positioning the pump within the annulus of a subterranean wellbore, the pump comprising at least one traveling valve positioned above at least two standing valves having a cylindrical bushing positioned therebetween and in fluid communication therewith, a cylindrical barrel and at least one reciprocating piston operative to open and close the valves, injecting fluids into the annulus of the wellbore, operating the pump by reciprocally moving the piston upwardly, opening the at least one standing valve downhole of the bushing, the at least one downhole standing valve in fluid communication with a vortex initiator, drawing fluids from the reservoir and creating a vortex into the bushing, opening the at least one standing valve uphole of the bushing, drawing fluids from the bushing into the cylindrical barrel, and receiving injected fluids from the annulus into the bushing, increasing the hydrostatic pressure therein, and moving the piston downwardly, opening the at least one traveling valve, increasing pressures within the bushing, and pumping the reservoir fluids uphole through the barrel.

12. The method of claim 11, wherein the injected fluids serve to increase and maintain sufficient hydrostatic pressure within the bushing to open the uphole standing valve when the piston moves upwardly.

13. The method of claim 11, wherein moving the piston downwardly closes the at least one uphole standing valve, minimizing fluids from exiting the bushing to the annulus.

14. The method of claim 11, wherein the method comprises allowing minute amounts of fluids to exit the bushing, cleaning the fluid ports.

15. A modified reciprocating pump for recovering reservoir fluids from a subterranean wellbore, the pump having at least one traveling valve, at least two standing valves, and a cylindrical bushing positioned between the at least two standing valves, and at least one reciprocating piston operative to open and close the at least one traveling valve, the pump comprising:

the at least one traveling valve having:

a cylindrical housing, a tubular insert, releasably positioned within the housing, the insert having a fluid inlet end, a fluid outlet end, and a sidewall, the inlet end forming a valve ball stop and the sidewall forming at least one fluid port therethrough, a valve ball, and a valve seat, releasably positioned within the housing, wherein ball is sealingly received by the ball stop to plug the inlet end of the insert, creating a vacuum thereabove, and drawing fluids through the at least one fluid ports into the insert, and wherein ball is sealingly received by the valve seat to close the valve;

wherein one of the at least two standing valves are in fluid communication with a vortex initiator.

16. The pump of claim 15, wherein the vortex initiator comprises a tubular element having a top end and a bottom end and a fluid flow passage therebetween for receiving fluids from the outlet end of the tubular insert.

17. The pump of claim 15, wherein the vortex initiator forms inwardly extending flanges within the fluid flow passage, the flanges each comprises two helically directed surfaces for creating a fluid vortex, increasing fluid flow therethrough.

18. The pump of claim 15, wherein the valve further comprises a rod connector, releasably positioned within the housing, in fluid communication with the outlet end of the tubular insert.

19. The pump of claim 18, wherein the rod connector may for form at least one fluid port for directing fluid from the valve to the annular space.

* * * * *